US006189577B1

(12) United States Patent
Lee

(10) Patent No.: US 6,189,577 B1
(45) **Date of Patent: *Feb. 20, 2001**

(54) PAPERMAKERS FABRIC WITH STACKED MACHINE DIRECTION YARNS

(75) Inventor: Henry J. Lee, Summerville, SC (US)

(73) Assignee: AstenJohnson, Inc., Charleston, SC (US)

( * ) Notice: Under 35 U.S.C. 154(b), the term of this patent shall be extended for 0 days.

This patent is subject to a terminal disclaimer.

(21) Appl. No.: 09/431,891

(22) Filed: Nov. 2, 1999

Related U.S. Application Data

(63) Continuation of application No. 09/017,177, filed on Feb. 2, 1998, now Pat. No. 5,975,148, which is a continuation of application No. 08/640,165, filed on Apr. 30, 1996, now Pat. No. 5,713,396, which is a continuation-in-part of application No. 08/524,800, filed on Sep. 7, 1995, now Pat. No. 5,645,112, which is a continuation of application No. 08/288,158, filed on Aug. 10, 1994, now Pat. No. 5,449,026, which is a continuation of application No. 08/043,016, filed on Apr. 5, 1993, now abandoned, which is a continuation of application No. 07/855,904, filed on Apr. 13, 1992, now Pat. No. 5,199,467, which is a continuation of application No. 07/534,164, filed on Jun. 6, 1990, now Pat. No. 5,103,874.

(51) Int. Cl.[7] ..... D03D 13/00; D03D 15/00
(52) U.S. Cl. ..... 139/383 A; 139/383 AA
(58) Field of Search ..... 139/383 A

(56) References Cited

U.S. PATENT DOCUMENTS

| | | |
|---|---|---|
| 926,310 | 6/1909 | Zepp et al. . |
| 1,050,406 | 1/1913 | Veit . |
| 1,268,788 | 6/1918 | Brooks . |
| 1,775,144 | 9/1930 | Sherman . |

(List continued on next page.)

FOREIGN PATENT DOCUMENTS

| | | | |
|---|---|---|---|
| 3426264 | 1/1986 | (DE) | D21F/7/08 |
| 0144592 | 6/1985 | (EP) | D21F/1/00 |
| 0211426 | 2/1987 | (EP) | D21F/1/00 |
| 0259294 | 3/1988 | (EP) | D21F/1/00 |
| 0273892 | 7/1988 | (EP) | B01D/39/08 |
| 0278769 | 8/1988 | (EP) . | |
| 0580478 | 1/1994 | (EP) | D21F/1/00 |
| 2407291 | 5/1979 | (FR) | D21F/5/02 |
| 537288 | 6/1941 | (GB) . | |
| 1002421 | 8/1965 | (GB) . | |
| 1066975 | 4/1967 | (GB) . | |
| 1362684 | 8/1974 | (GB) . | |
| 2192907 | 1/1988 | (GB) . | |
| 2258249 | 2/1993 | (GB) | D03D/11/00 |
| 2292755 | 3/1996 | (GB) | D21F/1/00 |
| 12154 | 7/1996 | (GB) . | |
| 9104374 | 4/1991 | (WO) | D21F/7/08 |
| 001350 | 1/1993 | (WO) . | |

OTHER PUBLICATIONS

D. Attwood et al.; Drying of Paper and Paperboard; 1972; pp. 68–83.

J.F. Oliver and N. Wiseman; Water Removal In Wet Pressing: The Effect of Felt Roughenss; Dec./1978; pp Tr104–109.

L.H. Bushker and D.C. Cronin; The Relative Importance of Wet Press Variables In Water Removal; 1982; pp 25–34.

JWI Group's Schedule of Prices; Apr. 15, 1988; with advertisement of ENERTEX K–2.

* cited by examiner

*Primary Examiner*—Andy Falik
(74) *Attorney, Agent, or Firm*—Volpe and Koenig, P.C.

(57) ABSTRACT

A method for weaving a papermakers fabric having a system of flat monofilament machine direction yarns (hereinafter MD yarns) which are stacked to control the permeability of the fabric. The system of MD yarns comprises at least upper and lower layers of yarns. Preferably, each upper MD yarn is paired in a vertically stacked orientation with a lower MD yarn. In a low permeability embodiment, at least the upper MD yarns are flat monofilament yarns woven contiguous with each other.

10 Claims, 8 Drawing Sheets

U.S. PATENT DOCUMENTS

| | | | | |
|---|---|---|---|---|
| 1,830,620 | | 11/1931 | Pelton . | |
| 1,964,419 | * | 6/1934 | Asten | 139/383 A |
| 2,003,123 | * | 5/1935 | Specht | 139/383 A |
| 2,093,904 | | 9/1937 | Bierer | 18/53 |
| 2,135,057 | | 11/1938 | Slayter et al. | 74/231 |
| 2,554,034 | | 5/1951 | Koester et al. | 139/426 |
| 2,570,576 | | 10/1951 | Lord | 28/80 |
| 2,619,683 | | 12/1952 | Murray | 19/114 |
| 2,854,032 | | 9/1958 | Santos | 139/411 |
| 3,622,415 | | 11/1971 | Kunsman | 139/425 A |
| 3,657,068 | | 4/1972 | Ivanowicz | 162/358 |
| 3,815,645 | | 6/1974 | Codorniu | 139/383 |
| 3,851,681 | * | 12/1974 | Egan | 139/383 A |
| 4,026,331 | | 5/1977 | Lees et al. | 139/383 A |
| 4,123,022 | | 10/1978 | Dutt et al. | 245/10 |
| 4,142,557 | | 3/1979 | Kositzke | 139/425 A |
| 4,184,519 | * | 1/1980 | McDonald et al. | 139/383 A |
| 4,290,209 | | 9/1981 | Buchanan et al. | 34/123 |
| 4,308,897 | | 1/1982 | Westhead | 139/383 A |
| 4,351,874 | | 9/1982 | Kirby | 428/229 |
| 4,356,225 | | 10/1982 | Dufour | 428/234 |
| 4,369,218 | | 1/1983 | Mazere | 139/383 A |
| 4,379,735 | | 4/1983 | MacBean | 162/348 |
| 4,414,263 | | 11/1983 | Miller et al. | 428/234 |
| 4,421,819 | | 12/1983 | Baker | 428/229 |
| 4,423,755 | | 1/1984 | Thompson | 139/383 A |
| 4,438,788 | | 3/1984 | Harwood | 139/383 A |
| 4,438,789 | | 3/1984 | MacBean | 139/383 A |
| 4,461,803 | | 7/1984 | Booth et al. | 428/234 |
| 4,469,142 | | 9/1984 | Harwood | 139/383 A |
| 4,470,434 | | 9/1984 | Vuorio | 139/425 A |
| 4,537,816 | | 8/1985 | Booth et al. | 428/234 |
| 4,565,735 | | 1/1986 | Murka, Jr. et al. | 428/234 |
| 4,569,883 | | 2/1986 | Renjilian | 139/383 A |
| 4,574,435 | | 3/1986 | Luciano et al. | 24/33 |
| 4,601,785 | | 7/1986 | Lilja et al. | 162/199 |
| 4,621,663 | | 11/1986 | Malmendier | 139/383 A |
| 4,676,278 | | 6/1987 | Dutt | 139/383 A |
| 4,695,498 | | 9/1987 | Sarrazin et al. | 428/121 |
| 4,705,601 | | 11/1987 | Chiu | 162/348 |
| 4,737,241 | | 4/1988 | Gulya | 162/199 |
| 4,749,007 | | 6/1988 | Malmendier | 139/383 A |
| 4,755,420 | | 7/1988 | Baker et al. | 428/222 |
| 4,806,208 | | 2/1989 | Penven | 162/199 |
| 4,815,499 | | 3/1989 | Johnson | 139/383 A |
| 4,824,525 | | 4/1989 | Penven | 162/358 |
| 4,829,681 | | 5/1989 | Josef | 139/383 A |
| 4,846,231 | | 7/1989 | Penven | 139/383 A |
| 4,865,083 | | 9/1989 | Cunnane | 139/383 A |
| 4,867,206 | | 9/1989 | Kufferath | 139/383 A |
| 4,883,096 | | 11/1989 | Penven | 139/383 A |
| 4,887,648 | | 12/1989 | Cunnane | 139/383 A |
| 4,902,383 | | 2/1990 | Penven | 139/383 A |
| 4,921,750 | | 5/1990 | Todd | 428/225 |
| 4,938,269 | | 7/1990 | Nicholas et al. | 139/383 A |
| 4,989,647 | | 2/1991 | Marchand | 139/383 A |
| 4,991,630 | | 2/1991 | Penven | 139/383 |
| 5,023,132 | | 6/1991 | Stanley et al. | 428/234 |
| 5,066,532 | | 11/1991 | Gaisser | 428/137 |
| 5,089,324 | | 2/1992 | Jackson | 139/383 A |
| 5,103,874 | | 4/1992 | Lee | 139/383 A |
| 5,114,777 | | 5/1992 | Gaisser | 139/383 A |
| 5,117,865 | | 6/1992 | Lee | 139/383 A |
| 5,151,316 | | 9/1992 | Durkin et al. | 139/383 A |
| 5,164,249 | | 11/1992 | Tyler et al. | 139/383 A |
| 5,167,261 | | 12/1992 | Lee | 139/383 A |
| 5,199,467 | | 4/1993 | Lee | 139/383 A |
| 5,230,371 | | 7/1993 | Lee | 139/383 A |
| 5,254,398 | | 10/1993 | Graisser | 139/383 A |
| 5,343,896 | | 9/1994 | Schroder et al. | 139/383 A |
| 5,358,014 | | 10/1994 | Kovar | 139/383 A |
| 5,366,778 | | 11/1994 | Johnson | 139/383 AA |
| 5,449,026 | | 9/1995 | Lee | 139/383 A |
| 5,503,196 | | 4/1996 | Josef et al. | 139/383 A |
| 5,597,450 | | 1/1997 | Baker et al. | 139/383 A |
| 5,645,112 | | 7/1997 | Lee | 139/383 A |
| 5,713,396 | | 2/1998 | Lee | 139/383 A |
| 5,769,131 | | 6/1998 | Whitlock et al. | 139/383 AA |
| 5,975,148 | * | 11/1999 | Lee | 138/383 A |

PAPERMAKERS FABRIC WITH STACKED MACHINE DIRECTION YARNS

This application is a continuation of application Ser. No. 09/017,177, which was filed on Feb. 2, 1998 and issued on Nov. 2, 1999 as Pat. No. 5,975,148; which is a continuation of application Ser. No. 08/640,165 which was filed on Apr. 30, 1996 and issued on Feb. 3, 1998 as Pat. No. 5,713,396; which is a continuation-in-part of application Ser. No. 08/524,800 which was filed on Sep. 7, 1995 and issued on Jul. 8, 1997 as Pat. No. 5,645,112; which is a continuation of application Ser. No. 08/288,158 which was filed on Aug. 10, 1994 and issued on Sep. 12, 1995 as Pat. No. 5,449,026; which is a continuation of application Ser. No. 08/043,016 which was filed on Apr. 5, 1993, now abandoned; which is a continuation of application Ser. No. 07/855,904 which was filed on Apr. 13, 1992 and issued on Apr. 6, 1993 as Pat. No. 5,199,467; which is a continuation of application Ser. No. 07/534,164, filed Jun. 6, 1990 and issued on Apr. 14, 1992 as Pat. No. 5,103,874.

BACKGROUND OF THE INVENTION

1. Field of the Invention

The present invention relates to papermakers fabrics and in particular to fabrics comprised of flat monofilament yarns.

2. Description of Related Art

Papermaking machines generally are comprised of three sections: forming, pressing, and drying. Papermakers fabrics are employed to transport a continuous paper sheet through the papermaking equipment as the paper is being manufactured. The requirements and desirable characteristics of papermakers fabrics vary in accordance with the particular section of the machine where the respective fabrics are utilized.

With the development of synthetic yarns, shaped monofilament yarns have been employed in the construction of papermakers fabrics. For example, U.S. Pat. No. 4,290,209 discloses a fabric woven of flat monofilament warp yarns; U.S. Pat. No. 4,755,420 discloses a non-woven construction where the papermakers fabric is comprised of spirals made from flat monofilament yarns.

Numerous weaves are known in the art which are employed to achieve different results. For example, U.S. Pat. No. 4,438,788 discloses a dryer fabric having three layers of cross machine direction yarns interwoven with a system of flat monofilament machine direction yarns such that floats are created on both the top and bottom surfaces of the fabric. The floats tend to provide a smooth surface for the fabric.

Permeability is an important criteria in the design of papermakers fabrics. In particular, with respect to fabrics made for running at high speeds on modern drying equipment, it is desirable to provide dryer fabrics with relatively low permeability.

U.S. Pat. No. 4,290,209 discloses the use of flat monofilament warp yarns woven contiguous with each other to provide a fabric with reduced permeability. However, even where flat warp yarns are woven contiguous with each other, additional means, such as stuffer yarns, are required to reduce the permeability of the fabric. As pointed out in that patent, it is desirable to avoid the use of fluffy, bulky stuffer yarns to reduce permeability which make the fabric susceptible to picking up foreign substances or retaining water.

U.S. Pat. No. 4,290,209 and U.S. Pat. No. 4,755,420 note practical limitations in the aspect ratio (cross-sectional width to height ratio) of machine direction warp yarns defining the structural weave of a fabric. The highest practical aspect ratio disclosed in those patents is 3:1, and the aspect ratio is preferably, less than 2:1.

U.S. Pat. No. 4,621,663, assigned to the assignee of the present invention, discloses one attempt to utilize high aspect ratio yarns (on the order of 5:1 and above) to define the surface of a papermakers dryer fabric. As disclosed in that patent, a woven base fabric is provided to support the high aspect ratio surface yarns. The woven base fabric is comprised of conventional round yarns and provides structural support and stability to the fabric disclosed in that patent.

U.S. Pat. No. 4,815,499 discloses the use of flat yarns in the context of a forming fabric. That patent discloses a composite fabric comprised of an upper fabric and a lower fabric tied together by binder yarns. The aspect ratio employed for the flat machine direction yarns in both the upper and lower fabrics are well under 3:1.

SUMMARY OF THE INVENTION

The present invention provides a method for weaving a papermakers fabric having a system of flat monofilament machine direction yarns (hereinafter MD yarns) which are stacked to control the permeability of the fabric. The system of MD yarns comprises at least upper and lower layers of yarns. Preferably, each upper MD yarn is paired in a vertically stacked orientation with a lower MD yarn.

The fabric has a variety of industrial uses. For example, it may be used as a base fabric for a papermakers wet press felt or as a dryer fabric. Preferably, multiple layers of stacked CMD yarns are provided which are maintained in the stacked relationship by the flat stacked MD yarns to provide suitable void volume within the fabric. Preferably, three layers of stacked CMD yarns are provided. In a low permeability embodiment, at least the upper MD yarns are flat monofilament yarns woven contiguous with each other.

Preferably, the same type and size yarns are used throughout the machine direction yarn system and both the top and the bottom MD yarns. Where three layers of CMD yarns are used, the middle layer CMD yarns are preferably of a smaller diameter than the upper and lower CMD layer yarns if the fabric is intended to be used as a press base fabric. For dryer fabrics, the CMD yarns are preferably all the same.

It is an object of the invention to provide a method for weaving a papermakers fabric having permeability controlled with woven flat machine direction yarns.

Other objects and advantages will become apparent from the following description of presently preferred embodiments.

DETAILED DESCRIPTION OF THE PREFERRED EMBODIMENT

The preferred embodiment will be described with reference to drawing figures where the numerals represent like elements throughout.

Figure 1:
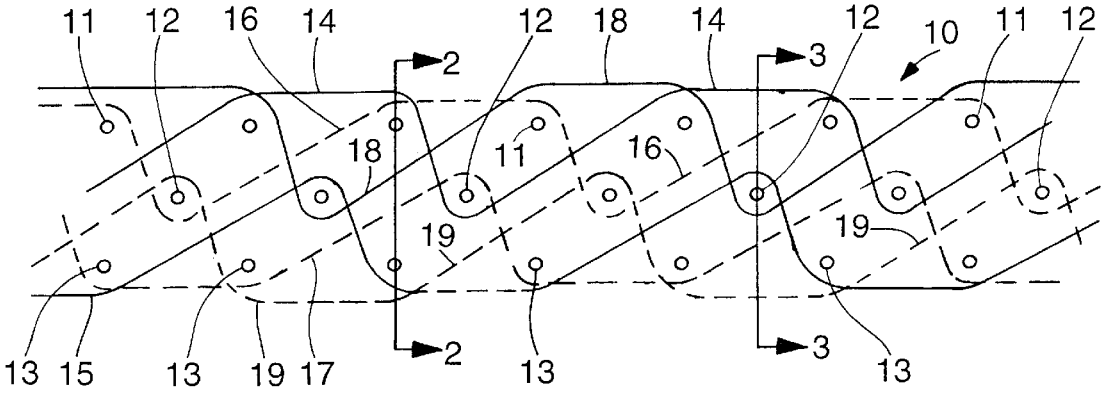
FIG. 1 is a schematic diagram of a papermakers fabric made in accordance with the teachings of the present invention.
Figure 2:
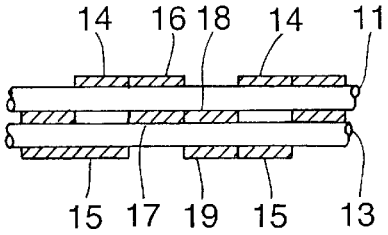
FIG. 2 is a cross-sectional view of the fabric depicted in FIG. 1 along line 2—2.
Figure 3:
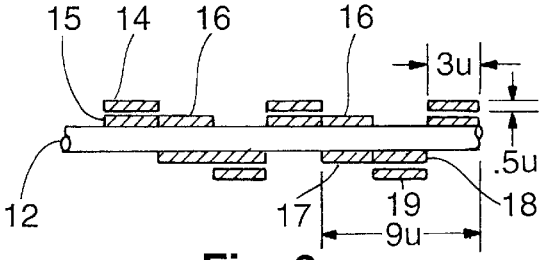
FIG. 3 is a cross-sectional view of the fabric depicted in FIG. 1 along line 3—3.

Referring to FIGS. 1–3, there is shown a papermakers dryer fabric 10 comprising upper, middle and lower layers of cross machine direction (hereinafter CMD) yarns 11, 12, 13, respectively, interwoven with a system of MD yarns 14–19 which sequentially weave in a selected repeat pattern. The MD yarn system comprises upper MD yarns 14, 16, 18 which interweave with CMD yarns 11, 12 and lower MD yarns 15, 17, 19 which interweave with CMD yarns 12, 13.

The upper MD yarns 14, 16, 18 define floats on the top surface of the fabric 10 by weaving over two upper layer CMD yarns 11 dropping into the fabric to weave in an interior knuckle under one middle layer CMD yarn 12 and under one CMD yarn 11 and thereafter rising to the surface of the fabric to continue the repeat of the yarn. The floats over upper layer CMD yarns 11 of upper MD yarns 14, 16, 18 are staggered so that all of the upper and middle layer CMD yarns 11, 12 are maintained in the weave.

As will be recognized by those skilled in the art, the disclosed weave pattern with respect to FIGS. 1–3, results in the top surface of the fabric having a twill pattern. Although the two-float twill pattern represented in FIGS. 1, 2, and 3 is a preferred embodiment, it will be recognized by those of ordinary skill in the art that the length of the float, the number of MD yarns in the repeat, and the ordering of the MD yarns may be selected as desired so that other patterns, twill or non-twill, are produced.

As best seen in FIGS. 2 and 3, lower MD yarns 15, 17, 19, weave directly beneath upper MD yarns 14, 16, 18, respectively, in a vertically stacked relationship. The lower yarns weave in an inverted image of their respective upper yarns. Each lower MD yarn 15, 17, 19 floats under two lower layer CMD yarns 13, rises into the fabric over one CMD yarn 13 and forms a knuckle around one middle layer CMD yarn 12 whereafter the yarn returns to the lower fabric surface to continue its repeat floating under the next two lower layer CMD yarns 13.

With respect to each pair of stacked yarns, the interior knuckle, formed around the middle layer CMD yarns 12 by one MD yarn, is hidden by the float of the other MD yarn. For example, in FIGS. 1 and 3, lower MD yarn 15 is depicted weaving a knuckle over CMD yarn 12 while MD yarn 14 is weaving its float over CMD yarns 11, thereby hiding the interior knuckle of lower MD yarn 15. Likewise, with respect to FIGS. 1 and 3, upper MD yarn 18 is depicted weaving a knuckle under yarn CMD yarn 12 while it is hidden by lower MD yarn 19 as it floats under CMD yarns 13.

Figure 18:
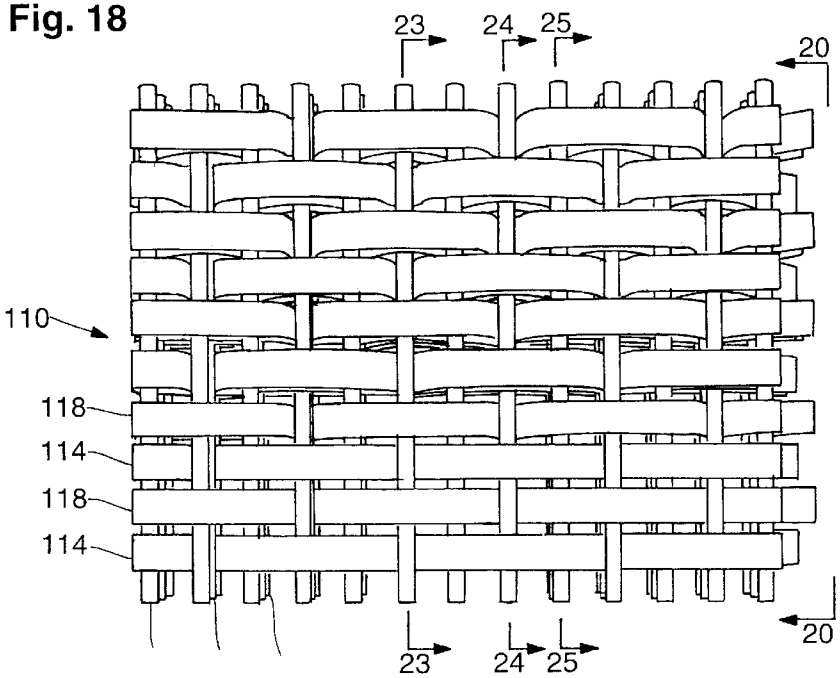
FIG. 18 is a top view of a fourth embodiment of a fabric made in accordance with the teachings of the present invention.
Figure 19:
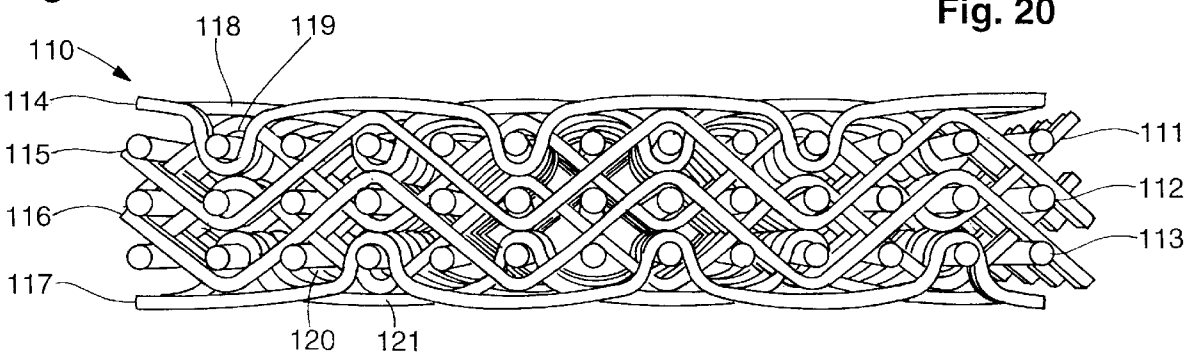
FIG. 19 is a side view of the fourth embodiment of a fabric made in accordance with the present invention.

The FIG. 18 upper MD yarns 14, 16, 18, are woven contiguous with respect to each other. This maintains their respective parallel machine direction alignment and reduces permeability. Such close weaving of machine direction yarns is known in the art as 100% warp fill as explained in U.S. Pat. No. 4,290,209. As taught therein (and used herein), actual warp count in a woven fabric may vary between about 80%–125% in a single layer and still be considered 100% warp fill.

The crowding of MD yarns 14, 16, and 18 also serves to force MD yarns 15, 17, 19, into their stacked position beneath respective MD yarns 14, 16, 18. Preferably MD yarns 15, 17, and 19 are the same size as MD yarns 14, 16, and 18 so that they are likewise woven 100% warp fill. This results in the overall fabric of the preferred embodiment having 200% warp fill of MD yarns.

Since the lower MD yarns 15, 17, 19 are also preferably woven 100% warp fill, they likewise have the effect of maintaining the upper MD yarns 14, 16, 18 in stacked relationship with the respect to lower MD yarns 15, 17, 19. Accordingly, the respective MD yarn pairs 14 and 15, 16 and 17, 18 and 19 are doubly locked into position thereby enhancing the stability of the fabric.

As set forth in the U.S. Pat. No. 4,290,209, it has been recognized that machine direction flat yarns will weave in closer contact around cross machine direction yarns than round yarns. However, a 3:1 aspect ratio was viewed as a practical limit for such woven yarns in order to preserve overall fabric stability. The present stacked MD yarn system preserves the stability and machine direction strength of the fabric and enables the usage of yarns with increased aspect ratio to more effectively control permeability.

The high aspect ratio of the MD yarns translates into reduced permeability. High aspect ratio yarns are wider and thinner than conventional flat yarns which have aspect ratios less than 3:1 and the same cross-sectional area. Equal cross-sectional area means that comparable yarns have substantially the same linear strength. The greater width of the high aspect ratio yarns translates into fewer interstices over the width of the fabric than with conventional yarns so that fewer openings exist in the fabric through which fluids may flow. The relative thinness of the high aspect ratio yarns enables the flat MD yarns to more efficiently cradle, i.e. brace, the cross machine direction yarns to reduce the size of the interstices between machine direction and cross machine direction yarns.

Figure 4:
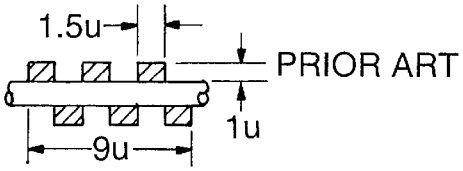
FIG. 4 is a cross-sectional view of a prior art weave construction.

For example, as illustrated in FIG. 4, a fabric woven with a single layer system of a flat machine direction warp having a cross-sectional width of 1.5 units and a cross-sectional height of 1 unit, i.e. an aspect ratio of 1.5:1, is shown. Such fabric could be replaced by a fabric having the present dual stacked MD yarn system with MD yarns which are twice the width, i.e. 3 units, and half the height, i.e. 0.5 units. Such MD yarns having a fourfold greater aspect ratio of 6:1, as illustrated in FIG. 3.

The thinner, wider MD yarns more efficiently control permeability while the machine direction strength of the fabric remains essentially unaltered since the cross-sectional area of the MD yarns over the width of the fabric remains the same. For the above example, illustrated by FIGS. 3 and 4, the conventional single MD yarn system fabric has six conventional contiguous flat yarns over 9 units of the fabric width having a cross-sectional area of 9 square units, i.e. 6*(1 u.*1.5 u.). The thinner, wider high aspect ratio yarns, woven as contiguous stacked MD yarns, define a fabric which has three stacked pairs of MD yarns over 9 units of fabric width. Thus such fabric also has a cross-sectional area of 9 square units, i.e. (3*(0.5u.* 3 u.))+(3*(0.5 u.* 3 u.)), over 9 units of fabric width.

In one example, a fabric was woven in accordance with FIGS. 1, 2 and 3, wherein the CMD yarns 11, 12, 13 were polyester monofilament yarns 0.6 mm in diameter interwoven with MD yarns 14–19 which were flat polyester monofilament yarns having a width of 1.12 mm and a height of 0.2 mm. Accordingly, the aspect ratio of the flat MD yarns was 5.6:1. The fabric was woven at 48 warp ends per inch with a loom tension of 40 PLI (pounds per linear inch) and 12.5 CMD pick yarns per inch per layer (three layers).

The fabric was heat set in a conventional heat setting apparatus under conditions of temperature, tension and time within known ranges for polyester monofilament yarns. For example, conventional polyester fabrics are heat set within parameters of 340° F.–380° F. temperature, 6–15 PLI (pounds per linear inch) tension, and 3–4 minutes time. However, due to their stable structure, the fabrics of the present invention are more tolerant to variations in heat setting parameters.

The fabric exhibited a warp modulus of 6000 PSI (pounds per square inch) measured by the ASTM D-1682-64 standard of the American Society for Testing and Materials. The fabric stretched less that 0.2% in length during heat setting. This result renders the manufacture of fabrics in accordance with the teachings of the present invention very reliable in achieving desired dimensional characteristic as compared to conventional fabrics.

The resultant heat set fabric had 12.5 CMD yarns per inch per layer with 106% MD warp fill with respect to both upper and lower MD yarns resulting in 212% actual warp fill for the fabric. The finished fabric has a permeability of 83 CFM as measured by the ASTM D-737-75 standard.

Figure 5:
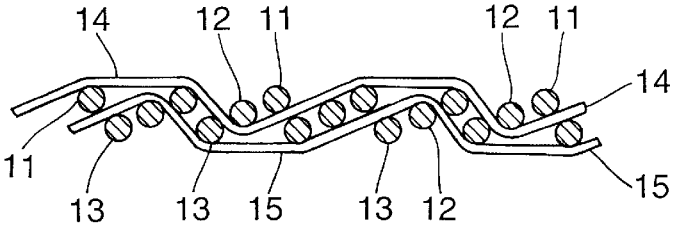
FIG. 5 illustrates the actual yarn structure of the fabric depicted in FIG. 1 in the finished fabric showing only two representative stacked MD yarns.

As illustrated in FIG. 5, when the fabric 10 is woven the three layers of CMD yarns 11, 12, 13 become compressed. This compression along with the relatively thin dimension of the MD yarns reduces the caliper of the fabric. Accordingly, the overall caliper of the fabric can be maintained relatively low and not significantly greater than conventional fabrics woven without stacked MD yarn pairs. In the above example, the caliper of the finished fabric was 0.050 inches.

It will be recognized by those of ordinary skill in the art that if either top MD yarns 14, 16, 18 or bottom MD yarns 15, 17, 19 are woven at 100% warp fill, the overall warp fill for the stacked fabric will be significantly greater than 100% which will contribute to the reduction of permeability of the fabric. The instant fabric having stacked MD yarns will be recognized as having a significantly greater percentage of a warp fill than fabrics which have an actual warp fill of 125% of non-stacked MD yarns brought about by crowding and lateral undulation of the warp strands. Although the 200% warp fill is preferred, a fabric may be woven having 100% fill for either the upper or lower MD yarns with a lesser degree of fill for the other MD yarns by utilizing yarns which are not as wide as those MD yarns woven at 100% warp fill. For example, upper yarns 14, 16, 18 could be 1 unit wide with lower layer yarns 15, 17, 19 being 0.75 units wide which would result in a fabric having approximately 175% warp fill.

Such variations can be used to achieve a selected degree of permeability. Alternatively, such variations could be employed to make a forming fabric. In such a case, the lower MD yarns would be woven 100% warp fill to define the machine side of the fabric and the upper MD yarns would be woven at a substantially lower percentage of fill to provide a more open paper forming surface.

Figure 6:
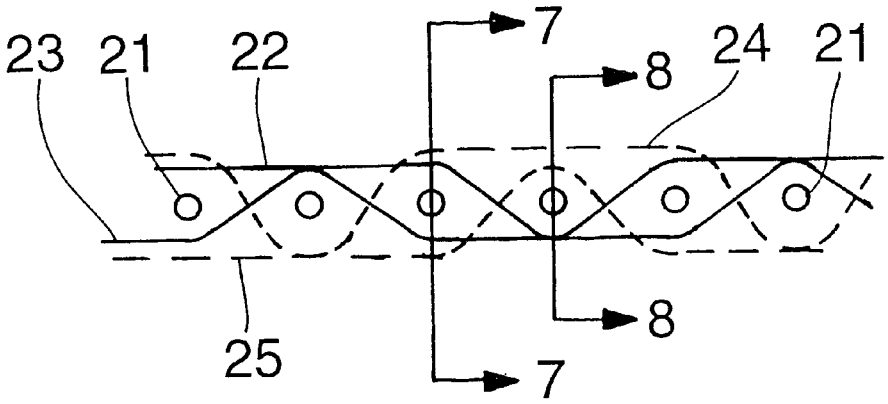
FIG. 6 is a schematic view of a second embodiment of a fabric made in accordance with the present invention.
Figure 7:
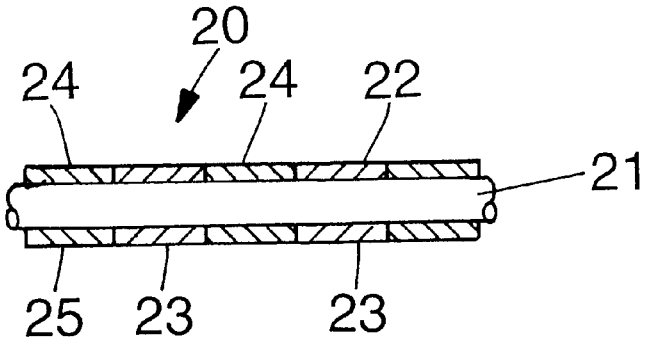
FIG. 7 is a cross-sectional view of the fabric depicted in FIG. 6 along line 7—7.
Figure 8:
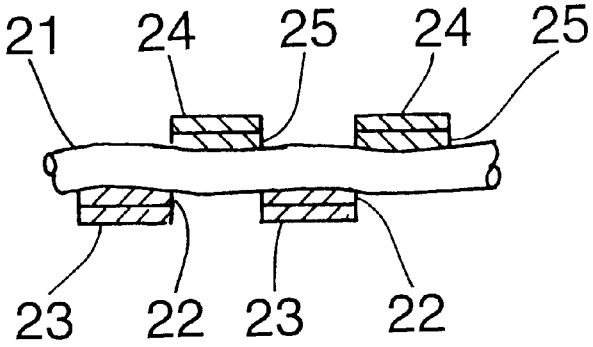
FIG. 8 is a cross-sectional view of the fabric depicted in FIG. 6 along line 8—8.
Figure 11:
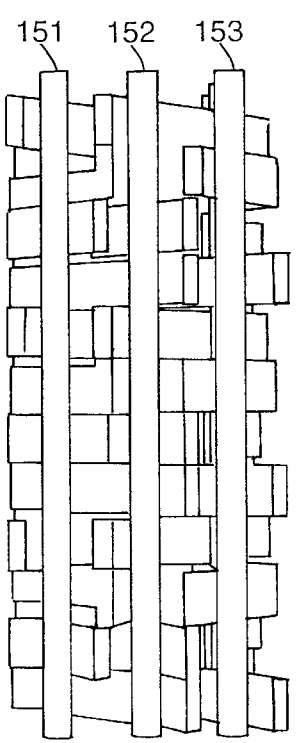
FIG. 11 is a front view of the third embodiment of a fabric made in accordance with the present invention.

Referring to FIGS. 6, 7 and 8, there is shown a second preferred embodiment of a fabric 20 made in accordance with the teachings of the present invention. Papermakers fabric 20 is comprised of a single layer of CMD yarns 21 interwoven with a system of stacked MD yarns 22–25 which weave in a selected repeat pattern. The MD yarn system comprises upper MD yarns 22, 24 which define floats on the top surface of the fabric 20 by weaving over three CMD yarns 21, dropping into the fabric to form a knuckle around the next one CMD yarn 21, and thereafter continuing to float over the next three CMD yarns 21 in the repeat.

Lower MD yarns 23, 25, weave directly beneath respective upper MD yarns 22, 24 in a vertically stacked relationship. The lower MD yarns weave in an inverted image of their respective upper MD yarns. Each lower MD yarn 23, 25 floats under three CMD yarns 21, weaves upwardly around the next one CMD yarn forming a knuckle and thereafter continues in the repeat to float under the next three CMD yarns 21.

As can be seen with respect to FIGS. 6 and 8, the knuckles formed by the lower MD yarns 23, 25 are hidden by the floats defined by the upper MD yarns 22, 24 respectively. Likewise the knuckles formed by the upper MD yarns 22, 24 are hidden by the floats of the lower MD yarns 23, 25 respectively. The caliper of the fabric proximate the knuckle area shown in FIG. 8, has a tendency to be somewhat greater than the caliper of the fabric at non-knuckle CMD yarns 21, shown in FIG. 7. However, the CMD yarns 21 around which the knuckles are formed become crimped which reduces the caliper of the fabric in that area as illustrated in FIG. 8. Additionally, slightly larger size CMD yarns may be used for CMD yarns 21, shown in FIG. 7, which are not woven around as knuckles by the MD yarns.

A fabric for use as a dryer fabric was woven in accordance with FIGS. 6–8, wherein the CMD yarns 21 were polyester monofilament yarns 0.7 mm in diameter interwoven with MD yarns 22–25 which were flat polyester monofilament yarns having a width of 1.12 mm and a height of 0.2 mm. Accordingly, the aspect ratio of the flat MD yarns was 5.6:1. The fabric was woven at 22 CMD pick yarns per inch. The fabric was heat set using conventional methods. The fabric exhibited a modulus of 6000 PSI. The fabric stretched less than 0.2% in length during heat setting. The resultant fabric had 22 CMD yarns per inch with 106% MD warp fill with respect to both upper and lower MD yarns resulting in 212% actual warp fill for the fabric. The finished fabric had a caliper of 0.048 inches and an air permeability of 60 CFM.

A fabric for use as a base fabric for a press felt was woven in accordance with FIGS. 6–8 where in the CMD yarns 21 were constructed of 0.019" and 0.012" in diameter alternating nylon yarns interwoven with 0.30 mm by 0.90 mm flat nylon machine direction monofilament yarns. The fabric was woven at 15 to 19 picks per inch for the CMD yarns and 45 to 48 ends per inch for the MD yarns. A base fabric with higher permeability was woven of the same design but using 0.30 mm by 0.85 mm flat nylon yarns for the machine direction yarns instead of the wider 0.30 mm by 0.90 mm nylon yarns. To complete the press felt, batt material was needled onto the base fabric in a conventional manner.

The preferred inverted image weave of the lower MD yarns facilitates the creation of seaming loops at the end of the fabric which enable the fabric ends to be joined together. In forming a seaming loop, the upper MD yarns extend beyond the end of the fabric and the respective lower yarns are trimmed back a selected distance from the fabric end. The upper MD yarns are then bent back upon themselves and rewoven into the space vacated by the trimmed lower MD yarns. When the upper MD yarns are backwoven into the space previously occupied by the lower MD yarns, their crimp matches the pattern of the lower MD yarns, thereby locking the resultant end loops in position. Similarly, alternate top MD yarns can be backwoven tightly against the end of the fabric such that loops formed on the opposite end of the fabric can be intermeshed in the spaces provided by the non-loop forming MD yarns to seam the fabric via insertion of a pintle through the intermeshed end loops.

Since the top and bottom machine direction yarns are stacked, the resultant end loops are orthogonal to the plane of the fabric surface and do not have any twist. In conventional backweaving techniques, the loop defining yarns are normally backwoven into the fabric in a space adjacent to the yarn itself. Such conventional loop formation inherently imparts a twist to the seaming loop, see U.S. Pat. No. 4,438,788, FIG. 6.

Referring to FIGS. 9–17, there is shown a third preferred embodiment of a fabric 150 made in accordance with the teachings of the present invention which is particularly suited for use as a base fabric for a press felt. The fabric 150 has upper, middle and lower layers of cross machine direction yarns 151, 152 and 153, respectively, interwoven with a system of MD yarns 154 through 161, which sequentially weave in a selected repeat pattern. The MD yarn system has upper and lower stacked flat MD yarns that repeat on four MD yarn pairs 154 and 155, 156 and 157, 158 and 159, and 160 and 161. The MD yarn system interweaves with the three CMD layer yarns 151, 152 and 153. The stacked pairs of MD yarns repeat with respect to 12 CMD yarns, 4 from each CMD yarn layer.

Figure 9:
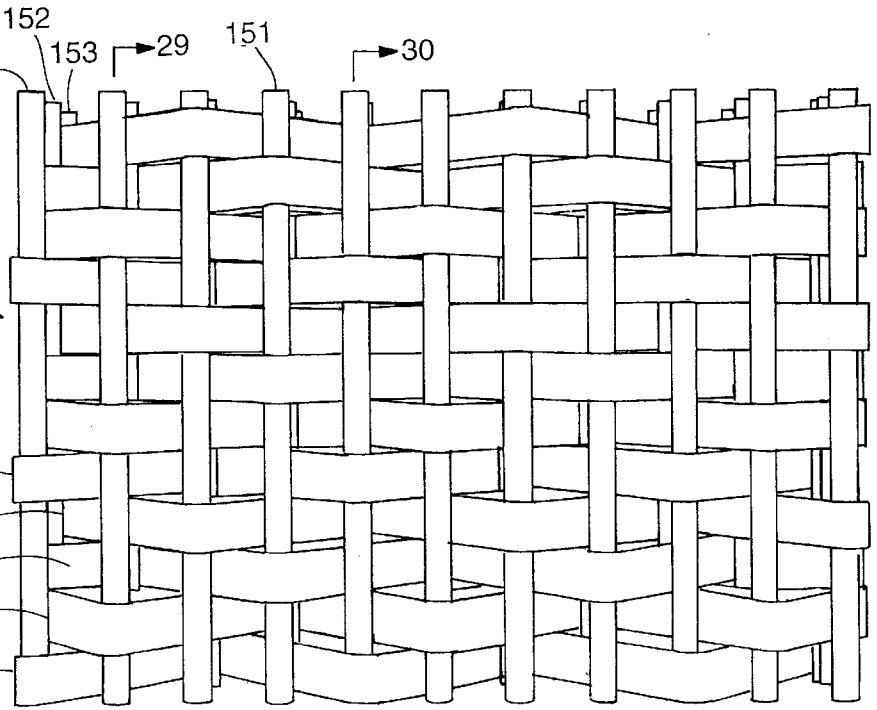
FIG. 9 is a top view of a third embodiment of a fabric made in accordance with the present invention.
Figure 10:
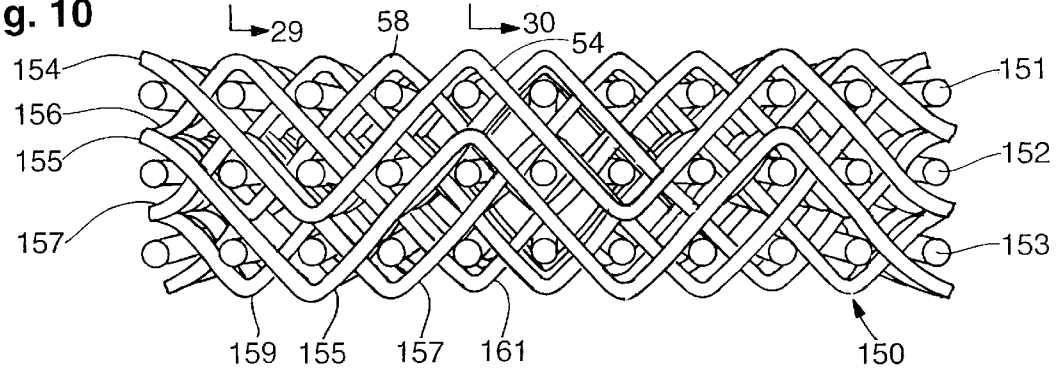
FIG. 10 is a side view of the third embodiment of a fabric made in accordance with the present invention.
Figure 12:
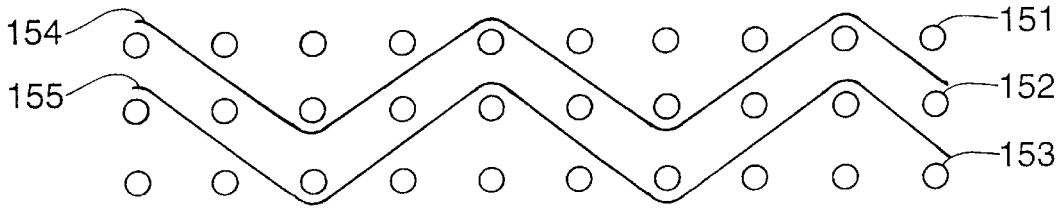
FIG. 12 is a schematic view of the third embodiment of a fabric made in accordance with the present invention showing only a first pair of stacked MD yarns.
Figure 13:
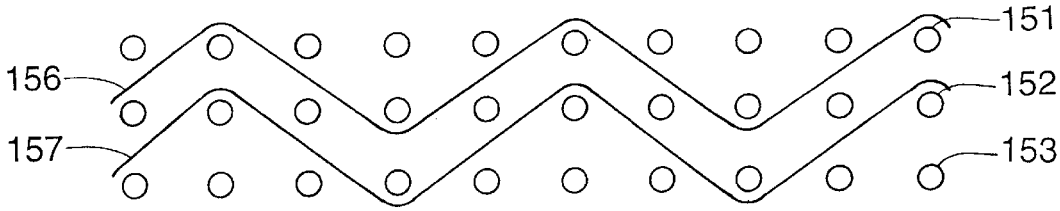
FIG. 13 is a schematic view of the third embodiment of a fabric made in accordance with the present invention showing only a second pair of stacked MD yarns.
Figure 14:
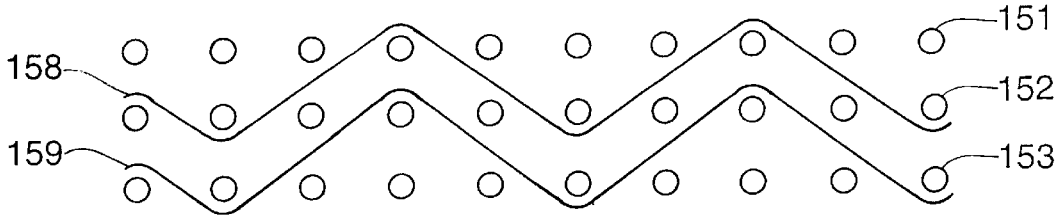
FIG. 14 is a schematic view of the third embodiment of a fabric made in accordance with the present invention showing only a third pair of stacked MD yarns.
Figure 15:
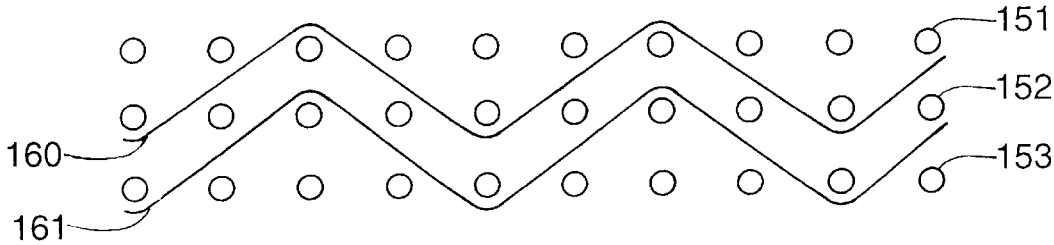
FIG. 15 is a schematic view of the third embodiment of a fabric made in accordance with the present invention showing only a fourth pair of stacked MD yarns.
Figure 16:
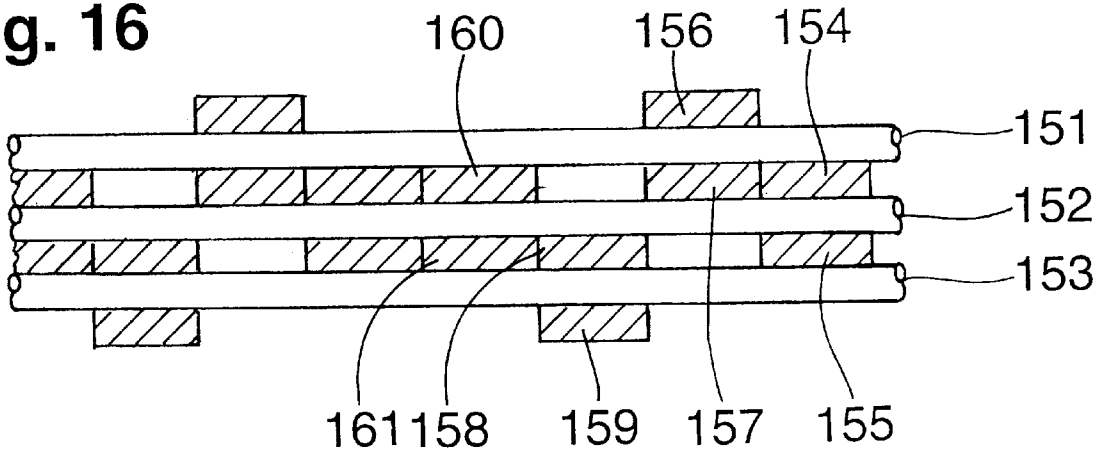
FIG. 16 is a cross sectional view of the fabric depicted in FIG. 9 along line 16—16.
Figure 17:
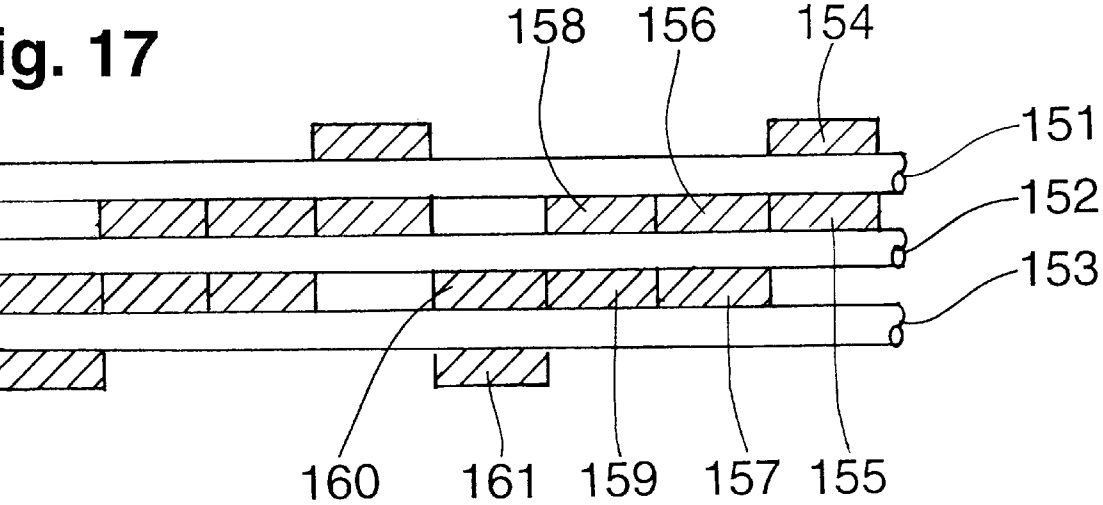
FIG. 17 is a cross sectional view of the fabric depicted in FIG. 9 along line 17—17.
Figure 20:
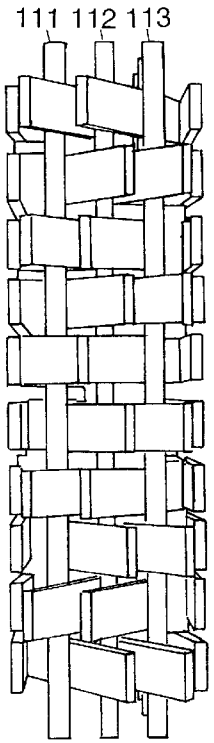
FIG. 20 is a view of the fabric depicted in FIG. 19 along line 20—20.

The relative stacking of both the MD and CMD yarns is shown in FIGS. 10–17. The upper layer MD yarns 154, 156, 158, 160 weave exclusively with the upper and middle layer CMD yarns 151, 152 and, preferably define interior knuckles under the middle layer CMD yarns 152 and exterior knuckles over the upper layer CMD yarns 151. As best seen in FIG. 9, the repeat of the upper MD yarns preferably define a crow foot pattern with respect to four upper layer CMD yarns 151, but the MD yarns may be ordered to define a regular twill pattern.

The lower layer MD yarns 155, 157, 159, 161 weave in a similar manner as upper layer MD yarns, but with respect to the middle and lower CMD yarn layers 152, 153. The lower layer MD yarns 155, 157, 159, 161 weave such that interior knuckles are defined by the lower MD yarns 155, 157, 159, 161 over the middle layer CMD yarns 152 which are vertically aligned with the exterior knuckles defined by the upper MD layer yarns 154, 156, 158, 160 over the upper layer CMD yarns. Similarly, the lower layer MD yarns 155, 157, 159, 161 weave exterior knuckles under lower layer CMD yarns 153 which are vertically aligned with the interior knuckles which are defined by the upper MD layer yarns 154, 156, 158, 160 under the middle layer CMD yarns 152.

A press felt base fabric produced in accordance with the third embodiment shown in FIGS. 9–17 is preferably woven 15–19 CMD yarns per inch in each layer using 0.5 mm diameter nylon yarns for the upper and lower CMD layers and 0.3 mm diameter nylon yarns for the middle CMD layer. The fabric is preferably woven at 45–48 MD yarns per inch in either a low permeability or a high permeability version. In the low permeability version, 1.06 mm wide by 0.25 mm high nylon MD yarns are used to produce a base fabric permeability in the range of 90–200 CFM. In the high permeability version 0.85 mm wide and 0.30 mm high nylon MD yarns are used to produce a base fabric permeability in the range of 200–400 CFM.

To form a press felt, batting 165 is needled onto the woven base fabric in a conventional manner having a weight in the preferred range of 2.2–2.6 oz/sq. ft. Preferably, a batt weight of 2.3 oz/sq. ft. is used.

A dryer fabric produced in accordance with the third embodiment shown in FIGS. 9–17 is preferably woven 15–19 CMD yarns per inch in each layer using 0.5 mm diameter polyester yarns. The fabric is preferably woven at 45–48 MD yarns per inch from 1.06 mm wide by 0.25 mm high polyester MD yarn to produce a base fabric permeability in the range of 90–200 CFM.

Referring to FIGS. 18–25, there is shown a fourth alternate embodiment of a papermakers fabric 110 which is also particularly suited for use as a press felt base fabric. The fabric 110 has upper, middle and lower layers of CMD yarns 111, 112, 113, respectively, interwoven with a system of machine direction MD yarns 114–121 which weave in a selected repeat pattern. As best seen in FIGS. 21–25, the MD yarns system repeat is defined by a first group of stacked MD yarns 112–117 and a second group of stacked MD yarns 118–121 which repeat with respect to 12 CMD yarns 111–113, four yarns from each of the upper, middle and lower CMD yarn layers.

The MD yarn system includes an upper interior MD yarn layer defined by MD yarns 115,119 which weave exclusively with the upper and middle CMD layer yarns 111, 112 forming knuckles over alternate upper layer CMD yarns 111 and under alternate middle layer CMD yarns 112. Upper interior MD yarns 115, 119 both weave between alternate pairs of upper and middle layer CMD yarns 111, 112 within the fabric repeat.

The MD yarn system also includes a lower interior MD yarn layer defined by MD yarns 116, 120 which weave exclusively with the middle and lower CMD layer yarns 112, 113 forming knuckles over alternate middle layer CMD yarns 112 and under alternate lower layer CMD yarns 113. Lower interior MD yarns 116, 120 both weave between alternate pairs of middle and lower layer CMD yarns 112, 113 within the fabric repeat.

The knuckles defined by the upper interior and lower interior MD yarn layers are vertically aligned in a manner similar to the upper and lower MD yarn layers of the embodiment disclosed in FIGS. 9–17.

The MD yarn system also includes an upper face MD yarn layer defined by MD yarns 114, 118 which weaves exclusively with the upper layer CMD yarns 111 with a float over three and a knuckle under one of the upper layer CMD yarns 111 within the repeat. The knuckles defined by upper face layer yarn 114 being vertically aligned with the knuckles defined by the upper interior MD yarn 115 under middle CMD layer yarns 112; the knuckles defined by upper face layer yarn 118 being vertically aligned with the knuckles defined by upper interior MD yarns 119 under middle CMD layer yarns 112.

The MD yarn system also includes a lower face MD yarn layer defined by MD yarns 117, 121 which weaves exclusively with the lower layer CMD yarns 113 with a float under three and a knuckle over one of the lower layer CMD yarns 113 within the repeat. The knuckles defined by lower face layer yarn 117 being vertically aligned with the knuckles defined by the lower interior MD yarn 116 over middle CMD layer yarns 112; the knuckles defined by lower face layer yarn 121 being vertically aligned with the knuckles defined by lower interior MD yarns 120 over middle CMD layer yarns 112.

Figure 21:
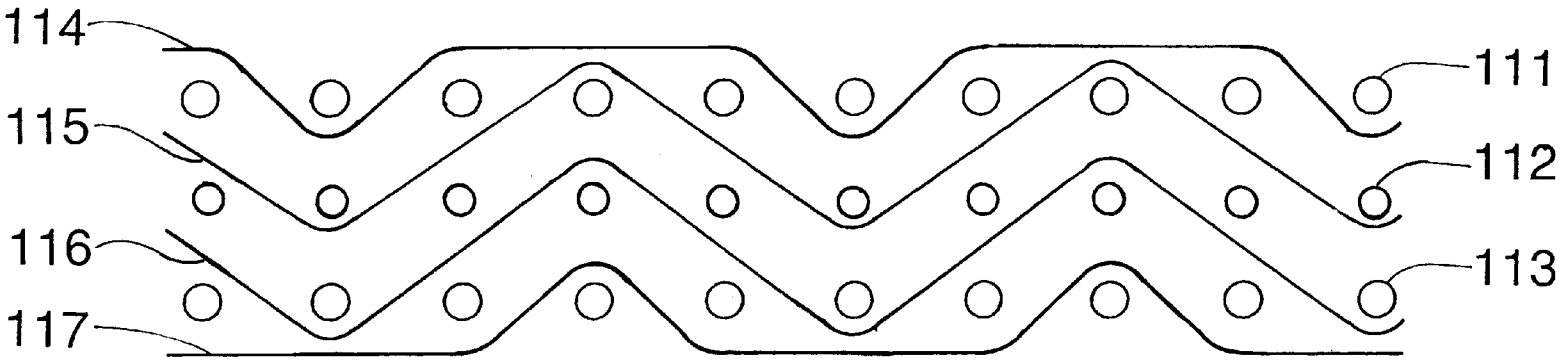
FIG. 21 is a schematic view of the fourth embodiment of a fabric made in accordance with the present invention showing four stacked MD yarns.
Figure 22:
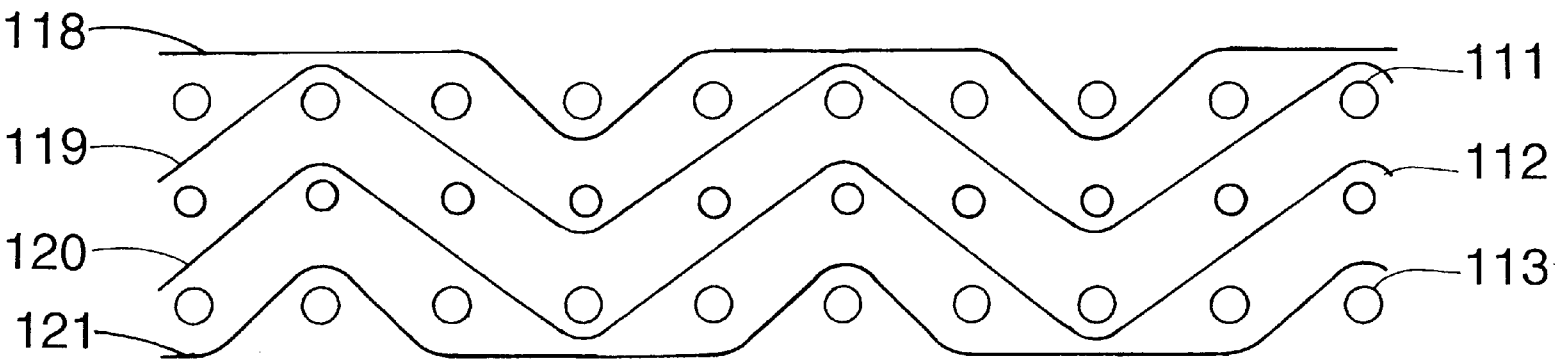
FIG. 22 is a schematic view of the fourth embodiment of a fabric made in accordance with the present invention showing the second layer of four stacked MD yarns.
Figure 23:
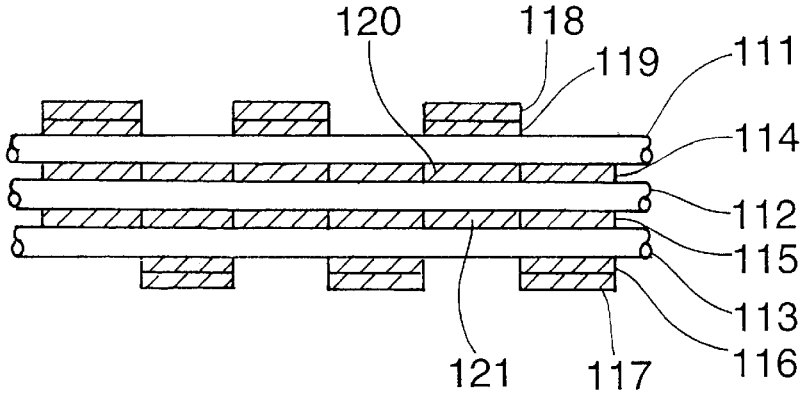
FIG. 23 is a cross-sectional view of the fabric depicted in FIG. 18 along line 23—23.
Figure 24:
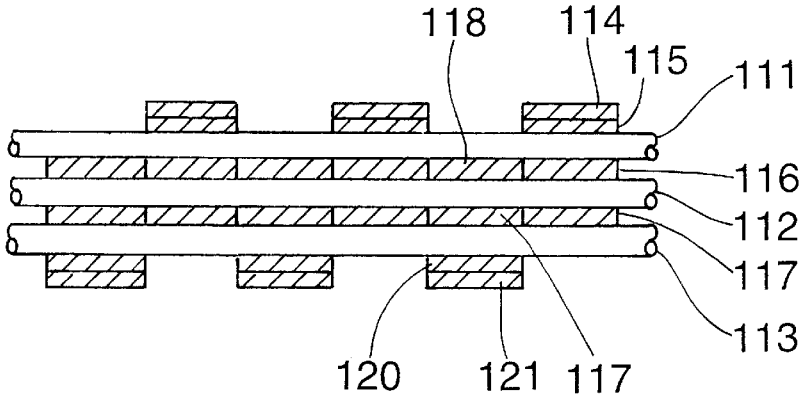
FIG. 24 is a cross-sectional view of the fabric depicted in FIG. 18 along line 24—24.
Figure 25:
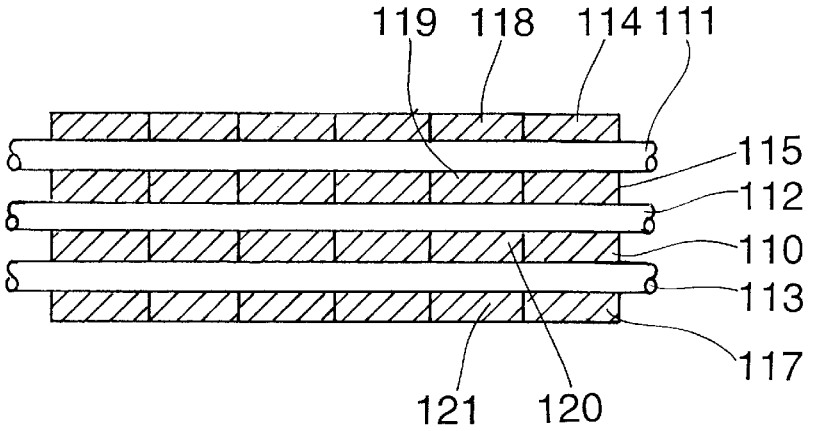
FIG. 25 is a cross-sectional view of the fabric depicted in FIG. 18 along line 25—25.

As a result of the repeat pattern alternate CMD yarns in each CMD yarn layer are crimped to a significantly greater degree to the weaving of knuckles by the MD yarns system as best seen in FIGS. 21, 22 and 25. None of the MD yarns weave knuckles about the other alternate CMD yarns of each of the upper middle and lower CMD layer 111, 112 and 113. Accordingly, a balanced weave similar to the balanced weave described with respect to the single CMD layer embodiment illustrated above is defined in a multi CMD layer fabric. It will be recognized to those of ordinary skill in the art that the MD yarn system could include four groups of stacked MD yarns within the repeat to define either a twill or broken twill surface pattern. However, as illustrated above only two groups of MD yarns 114–117 and 118–121 are required for the fabric's preferred construction.

A press felt base fabric produced in accordance with the fourth embodiment shown in FIGS. 18–25 is preferably woven 15–19 CMD yarns per inch in each layer using 0.5 mm diameter nylon yarns for the upper and lower CMD layers and 0.3 mm diameter nylon yarns for the middle CMD layer. The fabric is preferably woven at 90–96 MD yarns per inch in either a low permeability or a high permeability version. In the low permeability version, 1.06 mm wide by 0.25 mm high MD nylon yarns are used to produce a base fabric permeability in the range of 90–200 CFM. In the high permeability version 0.85 mm wide and 0.30 mm high MD nylon yarns are used to produce a base fabric permeability in the range of 200–400 CFM.

The addition of upper and lower face MD yarn layers does not substantially effect the fabric's permeability in contrast with fabrics made in accordance with the third embodiment depicted in FIGS. 9–17. The floats of the upper and lower face layer MD yarns provide a smoother support surface, but the inclusion of those yarns does not reduce the void volume of the base fabric in contrast with fabrics made in accordance with the third embodiment depicted in FIGS. 9–17.

To form a press felt, batting 125 is needled onto the woven base fabric in a conventional manner having a weight in the preferred range of 2.2–2.6 oz/sq. ft. Preferably, a batt weight of 2.3 oz/sq. ft. is used.

In the preferred low permeability embodiment, the upper face MD yarns 114 and 118, are woven contiguous with respect to each other. This maintains their respective parallel machine direction alignment and reduces permeability. Such close weaving of machine direction yarns is known in the art as 100% warp fill as explained in U.S. Pat. No. 4,290,209. As taught therein (and used herein), actual warp count in a woven fabric may vary between about 80%–125% in a single layer and still be considered 100% warp fill.

The crowding of MD yarns 114 and 118 also serves to force MD yarns 115–117 and 119–121, into their stacked position beneath respective MD yarns 114, 118. Preferably MD yarns 115–117 and 119–121 are the same size as MD yarns 114 and 118 so that they are likewise woven 100% warp fill. This results in the overall fabric of the preferred low permeability embodiment having 400% warp fill of MD yarns.

A dryer fabric produced in accordance with the fourth embodiment shown in FIGS. 18–25 is preferably woven 15–19 CMD yarns per inch in each layer using 0.5 mm diameter polyester yarns. The fabric is preferably woven at 90–96 MD yarns per inch from 1.06 mm wide by 0.25 mm high polyester MD yarn to produce a fabric having a permeability in the range of 90–200 CFM.

While the present invention has been described in terms of the preferred embodiment, other variations which are within the scope of the invention as defined in the claims will be apparent to those skilled in the art.

I claim:

1. A method for weaving a fabric with a relatively low caliper comprising:

providing a single layer of CMD yarns wherein first CMD yarns alternate with second CMD yarns;

weaving a first system of MD yarns in a repeat pattern with said CMD yarns such that at least one first system MD yarn weaves a knuckle under each first CMD yarn of said single CMD yarn layer and all of said first system MD yarns float over, each float being a continuous float over at least two CMD yarns, said second CMD yarns in the repeat pattern; and weaving a second system of MD yarns in a repeat pattern with said single layer CMD yarns such that at least one second system MD yarn weaves a knuckle over each first CMD yarn whereby said first CMD yarns become crimped thereby providing a relatively low caliper for the woven fabric.

2. The method for weaving a fabric according to claim 1 wherein said first CMD yarns have a first diameter and said second CMD yarns have a second larger diameter and the weaving by said first and second system MD yarns defines knuckles about the small diameter first CMD yarns.

3. A method for weaving a fabric according to claim 1 wherein every second system MD yarn weaves floats under all of said second CMD yarns within the second system MD yarn repeat pattern.

4. A method for weaving a fabric according to claim 1 wherein yarns having a round cross section are provided as said CMD yarns and yarns having a flattened cross-section are used for said first and second system MD yarns.

5. A method for weaving a fabric according to claim 1 wherein each said first system MD yarn weaves a float over three CMD yarns, two of which are second CMD yarns, and under a single first CMD yarn within the first system MD yarn repeat pattern.

6. A method for weaving a fabric according to claim 5 wherein every second system MD yarn weaves floats under all of said second CMD yarns within the second system MD yarn repeat pattern.

7. A method for weaving a fabric according to claim 6 wherein each said second system MD yarn weaves a float under three CMD yarns, two of which are second CMD yarns, and over a single first CMD yarn within the second system MD yarn repeat pattern.

8. A method for weaving a fabric according to claim 7 wherein yarns having a round cross section are provided as said CMD yarns and yarns having a flattened cross-section are used for said first and second system MD yarns.

9. The method for weaving a fabric according to claim 7 wherein said first CMD yarns have a first diameter and said second CMD yarns have a second larger diameter and the weaving by said first and second system MD yarns defines knuckles about the small diameter first CMD yarns.

10. A method for weaving a fabric according to claim 9 wherein yarns having a round cross section are provided as said CMD yarns and yarns having a flattened cross-section are used for said first and second system MD yarns.

* * * * *